United States Patent [19]

Takagi et al.

[11] Patent Number: 4,856,065

[45] Date of Patent: Aug. 8, 1989

[54] POWER FADER FOR A LOUDSPEAKER SYSTEM

[75] Inventors: Kazunori Takagi; Masahiko Ito, both of Saitama, Japan

[73] Assignee: Pioneer Electronic Corporation, Tokyo, Japan

[21] Appl. No.: 160,981

[22] Filed: Feb. 26, 1988

[30] Foreign Application Priority Data

Feb. 27, 1987 [JP] Japan ..... 62-27465[U]

[51] Int. Cl.[4] ..... H04R 5/02

[52] U.S. Cl. ..... 381/28; 381/98; 381/100

[58] Field of Search ..... 381/24, 28, 98, 100, 381/123

[56] References Cited

U.S. PATENT DOCUMENTS

| | | | |
|---|---|---|---|
| 2,846,503 | 8/1958 | Kump | 381/100 |
| 3,195,067 | 7/1965 | Klein | 381/28 |
| 3,222,455 | 12/1965 | Golik | 381/28 |
| 3,881,058 | 4/1975 | Klauck | 381/123 |
| 3,944,941 | 3/1976 | Tsuda | 381/123 |
| 4,424,416 | 1/1984 | Fukuoka | 381/98 |

*Primary Examiner*—Tommy P. Chin

*Attorney, Agent, or Firm*—Sughrue, Mion, Zinn, Macpeak & Seas

[57] ABSTRACT

In an adjustable power fader device for a loudspeaker system with at least four speakers right and left channel input signals are received by respective power fader circuits. Each power fader circuit has a variable resistor connected across its input terminals and a series of at least two speakers across its output terminals. The sliding terminal of the variable resistor is connected via a capacitor to the mid point of the series of speakers, one of which has good low pitch sound reproduction. The two sliding terminals of the respective power fader circuits are movable together and the level of audio signals applied to the loudspeakers is accordingly adjusted.

10 Claims, 2 Drawing Sheets

POWER FADER FOR A LOUDSPEAKER SYSTEM

FIELD OF THE INVENTION

The present invention relates to a power fader for controlling the levels of audio signals which are to be applied to loudspeakers located within the passenger compartment of a vehicle or the like, at front and rear positions of the compartment.

BACKGROUND OF THE INVENTION

A loudspeaker reproduction apparatus installed in the passenger compartment of a vehicle typically has a four-loudspeaker system in which a pair of front loudspeakers are located at both ends of an instrument panel or on the right and a left front doors and a pair of rear loudspeakers are located at both the ends of a rear deck or baggage space. The four-loudspeaker system is provided with a power fader for controlling and balancing the volume of sound from the front and the rear loudspeakers.

FIG. 5 shows a block diagram of a conventional loudspeaker system of the kind just described. The system comprises input terminals 1R and 1L for audio signals in a right and a left channel, respectively, variable resistors 2 and 3 which are operated in conjunction with each other, the sliding terminals 2' and 3' of the variable resistors, power amplifiers 4, 5, 6 and 7, a loudspeaker 8L located in a left front position, a loudspeaker 8R located in a right front position, a loudspeaker 9R located in a left rear position, a loudspeaker 9R located in a right rear position, and resistors $R_1$, $R_2$, $R_3$ and $R_4$. The audio signal in the left channel of an audio source is sent to the input terminal 1L so that the audio signal is applied to the loudspeakers 8L and 9L, through the resistors $R_1$ and $R_2$ and the power amplifiers 4 and 6, and is grounded through the sliding terminal 2' of the variable resistor 2. The audio signal in the right channel is sent to the input terminal 1R so that the audio signal is applied to the loudspeakers 8R and 9R, through the resistors $R_3$ and $R_4$ and the power amplifiers 5 and 7, and is grounded through the sliding terminal 3' of the variable resistor 3.

The variable resistors 2 and 3 constitute a power fader which is a front and rear sound volume balance control circuit. The sliding terminals 2' and 3' of the variable resistors 2 and 3 are moveable in order to permit control of the sound volume from the loudspeakers 8R, 8L, 9R and 9L and to permit the volumes to be balanced. When the sliding terminals 2' and 3' are moved in a direction as shown by arrows R in FIG. 5, the outputs from the rear loudspeakers 9R and 9L are increased and those from the front loudspeakers 8R and 8L are decreased. When the sliding terminals 2' and 3' are moved in a direction as shown by arrows F in FIG. 5, the outputs from the front loudspeakers 8R and 8L are increased and those from the rear loudspeakers 9R and 9L are decreased.

Since the size of a rear space in which the rear loudspeakers 9R and 9L are installed often is relatively large, when compared to the available space on an instrument panel, the diameters of the rear loudspeakers can be set at relatively large values of about 6 to 20 cm. Moreover, the trunk room of a vehicle is adjacent to the rear baggage space and can be used as a back cavity for the rear loudspeakers 9R and 9L. Accordingly, the low pitch range of sounds can be reproduced quite well by the rear loudspeakers. On the other hand, the diameters of the front loudspeakers 8R and 8L can be set only at small values of about 10 cm or less because of spatial restrictions. Furthermore, the limited space precludes use of a baffle effect for the front loudspeakers 8R and 8L. For these reasons, it is difficult to adequately reproduce the low pitch range of sounds with the front loudspeakers 8R and 8L.

Only the levels of the audio signals which are to be applied to the loudspeakers 8R, 8L, 9R and 9L are regulated by the conventional power fader. That regulation does not take into consideration the difference between the low-pitch sound reproduction characteristics of the front and the rear loudspeakers. Accordingly, the power fader has a drawback in that the frequency balance between reproduced sounds is subject to collapse. In particular, when the sliding terminals 2' and 3' of the variable resistors 2 and 3 are moved in the direction as shown by the arrows F in FIG. 5, the audio signals are only slightly applied to the rear loudspeakers 9R and 9L. As a result, the reproduced sounds do not adequately reproduce the low pitch range. In other words, the conventional power fader functions to apply the audio signals to the front and the rear loudspeakers in such a manner that the frequency characteristics of the audio signals are not taken into consideration. For that reason, if some of the loudspeakers have good low-pitch sound reproduction characteristics and the others have poor low-pitch sound reproduction characteristics, the quality of the reproduced sound as a whole is significantly changed as the power fader is operated.

The present invention is intended to eliminate the above-mentioned drawback.

Accordingly, it is an object of the present invention to provide a power fader in which a variable resistor is controlled so that even when an audio signal at a high level is applied to a front loudspeaker that has poor low-pitch sound reproduction characteristics, for example, the audio signal in the low pitch range of sounds is reproduced by a rear loudspeaker that has good low-pitch sound reproduction characteristics. Thus, the rear speaker acts maintains the quantity of the low-pitch part of the entire reproduced sound and, thus, maintains the quality of the entire reproduced sound within the listening area.

SUMMARY OF THE INVENTION

The power fader provided in accordance with the present invention is characterized in that the front and the rear loudspeakers are connected in series with each other between the output terminals of a power amplifier; a variable resistor is connected between the output terminals of the power amplifier; and a capacitor is connected between the sliding terminal of the variable resistor and the middle point of the series circuit consisting of the loudspeakers.

DETAILED DESCRIPTION OF THE INVENTION

Figure 1:
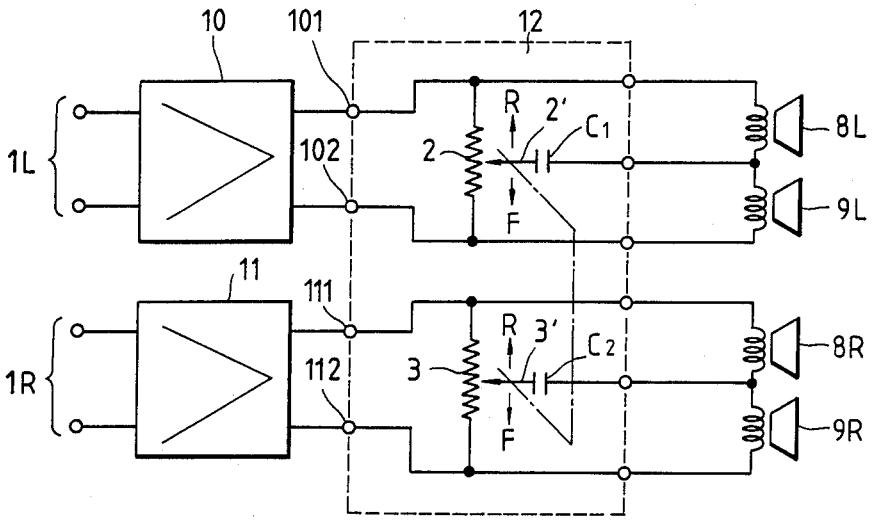
FIG. 1 shows a wiring diagram of a first embodiment of the present invention.

An embodiment of the invention is hereafter described with reference to FIGS. 1, 2 and 3. A power fader 12 is directly connected to power amplifiers 10 and 11 for amplifying audio signals in left and right channels, respectively. A pair of front loudspeakers 8R and 8L and a pair of rear loudspeakers 9R and 9L are directly connected to the power fader. A variable resistor 2 is included in the power fader 12. The two terminals of the variable resistor 2 are connected to the output terminals 101 and 102, respectively, of the power amplifier 10 for amplifying the audio signal in the left channel. The left front loudspeaker 8L and the left rear loudspeaker 9L are connected in series with each other and in parallel with the variable resistor 2. One terminal of a capacitor $C_1$ is connected to the sliding terminal 2' of the variable resistor 2, while the other terminal of the capacitor is connected to the middle point of the series circuit consisting of the left front loudspeaker 8L and the left rear loudspeaker 9L. Also included in the power fader 12 is a variable resistor 3. The two terminals of variable resistor 3 are connected to the output terminals 111 and 112, respectively, of the power amplifier 11 for amplifying the audio signal in the right channel. The right front loudspeaker 8R and the right rear loudspeaker 9R are connected in series with each other and in parallel with the variable resistor 3. One terminal of a capacitor $C_2$ is connected to the sliding terminal 3' of the variable resistor 3, while the other terminal of the capacitor is connected to the middle point of the series circuit consisting of the right front loudspeaker 8R and the right rear loudspeaker 9R. The sliding terminals of the variable resistors 2 and 3 included in the power fader 12 are slidable in conjunction with each other.

Figure 2A:
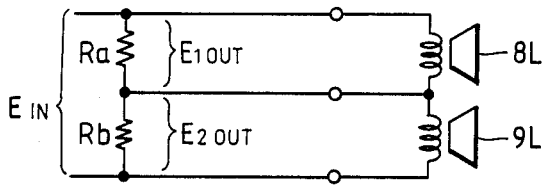
FIGS. 2(A), 2(B), and 2(C) wiring diagrams for describing the operation of the first embodiment.

When the sliding terminals 2' and 3' of the variable resistors 2 and 3 are in center positions, the capacitors $C_1$ and $C_2$ perform no significant function so that the power fader 12 becomes equivalent to a circuit shown in FIG. 2(A). That figure shows only the equivalent wiring of the left circuit of a loudspeaker system. The right circuit is comparable but is not shown in FIG. 2A or, for that matter, FIGS. 2(B) and 2(C). Viewing the circuit in FIG. 2A, the divided output voltages $E_{1OUT}$ and $E_{2OUT}$ across the divided resistances Ra and Rb of the variable resistor 2 are expressed as follows:

$$E_{1OUT} = E_{2OUT} = \frac{Ra}{Ra + Rb} \cdot E_{IN} = \frac{Rb}{Ra + Rb} \cdot E_{IN} = \frac{E_{IN}}{2} \quad (1)$$

In the equation (1), $E_{IN}$ denotes the input voltage to the left channel of the power fader 12.

Figure 2B:
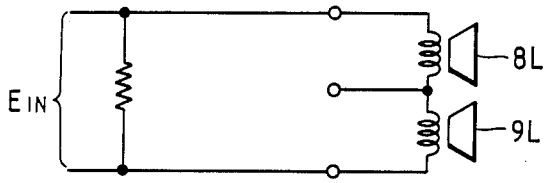

When the sliding terminals 2' and 3' of the variable resistors 2 and 3 are moved forward, as shown by arrows F in FIG. 1, the reactances of the capacitors $C_1$ and $C_2$ are so high for the low pitch range of audio that the capacitors become the equivalent of a switch that has been turned-off, as shown in FIG. 2(B). For that reason, the divided output voltages $E_{1OUT}$ and $E_{2OUT}$ and the input voltage $E_{IN}$ for the low pitch range of audio signals are expressed as follows:

$$E_{IN}=E_{1OUT}=E_{2OUT} \quad (2)$$

Therefore, the low-pitch components of the audio signals are applied to the front and the rear loudspeakers so that the low pitch range of sounds are reproduced by the front and the rear loudspeakers.

Figure 2C:
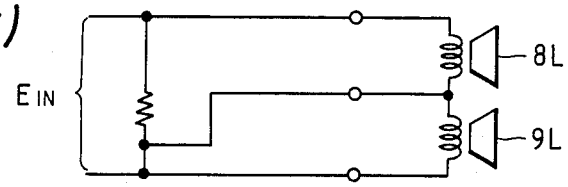

As for the intermediate and high pitch ranges of audio signals in this case, the power fader 12 becomes equivalent to a circuit shown in FIG. 2(C). The reactances of the capacitors $C_1$ and $C_2$ are so low for the intermediate and high pitch ranges of audio signals that the reactances are negligible in the equivalent circuit. For that reason, the divided output voltages $E_{1OUT}$ and $E_{2OUT}$ are expressed as follows:

$$E_{1OUT}=E_{IN},\ E_{2OUT}=0 \quad (3)$$

Therefore, the intermediate and high pitch ranges of sounds are reproduced by the front loudspeakers but are not reproduced by the rear loudspeakers.

Figure 3:
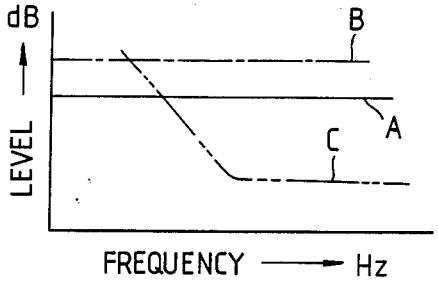
FIG. 3 shows a characteristic diagram for describing the frequency characteristics of the first embodiment.

FIG. 3 shows frequency characteristic diagrams A, B and C. The diagram A shown by a full line in FIG. 3 indicates the frequency characteristics of the audio signals which are applied to the front and the rear loudspeakers when the sliding terminals 2' and 3' of the variable resistors 2 and 3 are in the center positions. The diagrams B and C in FIG. 3, shown by a one-dot chain line and a two-dot change line, indicate the frequency characteristics of the audio signals which are applied to the front and the rear loudspeakers, respectively, with regard to the low pitch range of audio signals when the sliding terminals 2' and 3' of the variable resistors 2 and 3 are slid toward the front as shown by arrows F in FIG. 1.

A power fader provided in accordance with the present invention functions so that the low pitch range of sounds are reproduced by four loudspeakers which are a right and a left front speakers and a right and a left rear speaker. Only the intermediate and high pitch ranges of sounds are shifted to the front or the rear as the variable resistance is adjusted. For that reason, even when the operator wishes to move the source of sounds forward, toward the front of the passenger compartment, the low pitch range of sounds continue to be reproduced by the rear loudspeakers, which have good low-pitch sound reproduction characteristics. As a result, the quality of sound reproduced by all the loudspeakers does not decline in the low pitch range. Thus, the drawback of the quality of the entire reproduced sound being changed by operating the power fader is prevented.

Figure 5:
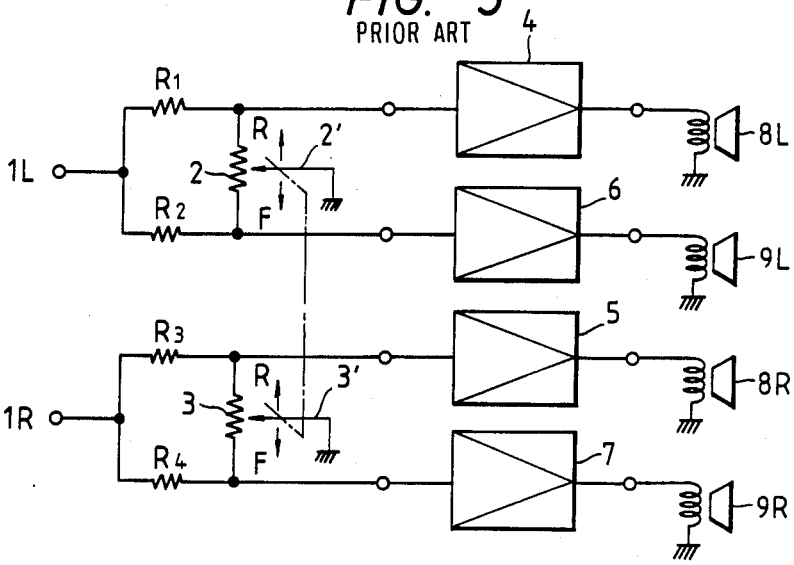
FIG. 5 PRIOR ART
FIG. 5 shows a wiring diagram of a conventional four-loudspeaker system.

The power fader 12 is connected between two power amplifiers 10, 11 and the loudspeakers 8L, 9L, 8R, 9R. If only the power fader 12 and one pair of the loudspeakers are provided in addition to the already-provided two power amplifiers and the already-provided other pair of the loudspeakers, a four-loudspeaker system which produces the above-mentioned practical effect can be realized in a simpler manner than the conventional four-loudspeaker system shown in FIG. 5.

Figure 4:
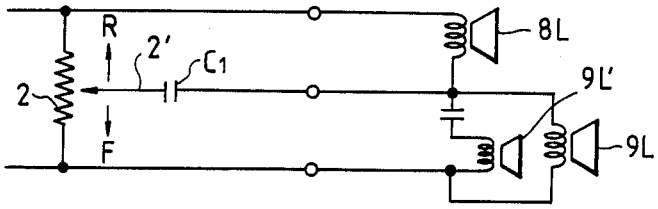
FIG. 4 shows a wiring diagram of a second embodiment of the present invention.

FIG. 4 shows another embodiment of the present device, which is a power fader connected to a double loudspeaker comprising a woofer 9L and a tweeter 9L, and produces the above-mentioned practical effect.

What is claimed is:

1. A power fader for a loudspeaker system, including at least a power amplifier having output terminals and at least two loudspeakers connected in a series circuit between said output terminals, which receive the output of the power amplifier, comprising:

a variable resistor connected between said output terminals in parallel with said series circuit, and having a moveable contact; and a capacitor connected between said moveable contact and a middle point between two of said loudspeakers in the series circuit;

wherein movement of said moveable contact changes the level of audio signals applied to the loudspeakers on each side of said middle point.

2. A loudspeaker system connectable to a first audio channel signal source and a second audio channel signal source and having a plurality of speakers, at least a first plurality of said speakers connected to said first audio channel signal source in a first series circuit to reproduce a first audio channel and a second plurality of said speakers connected to said second audio channel signal source in a second series circuit to reproduce a second audio channel and a power fader, comprising:

a first variable resistor having first and second terminals, connected to said first audio channel signal source in parallel with said first series circuit, and a sliding terminal; and a first capacitor connected between said sliding terminal and a middle point between two of said first plurality of speakers in said first series circuit.

3. The power fader of claim 2 further comprising:

a second variable resistor having first and second terminals, connected to said second audio channel signal source in parallel with said second series circuit, and a sliding terminal; and a second capacitor connected between said sliding terminal of said second variable resistor and a middle point between two of said second plurality of speakers in said second series circuit.

4. The power fader of claim 3 wherein said sliding terminals of said first and second variable resistors are operable to slide in conjunction with each other.

5. The power fader of claim 3 wherein said sliding terminals of said first and second variable resistors are physically coupled together and move under common control.

6. The speaker system of claim 2 wherein each of said first plurality of speakers and said second plurality of speakers includes at least one speaker capable of reproducing low pitch sound.

7. An improved power fader system, connectable between a source of audio signals separated into a first and a second channel, and a plurality of speakers divided into at least a first group and a second group for each of said first and second channels, said power fader system comprising:

a first power fader circuit comprising:

a first variable voltage divider means connected to receive said first channel and divide the voltage applied thereto into two outputs; and a first frequency sensitive switch means connected between said first variable voltage divider means and said first and second groups of speakers for said first channel and being operative in response to the frequency of the audio signals in said first channel to provide the input voltage to said first group of speakers of said first channel in a first frequency range and to provide the input voltage to both said first and second groups of speakers of said first channel in a second frequency range; and a second power fader circuit comprising:

a second variable voltage divider means connected to receive said second channel and divide the voltage applied thereto into two outputs; and a second frequency sensitive switch means connected between said second variable voltage divider means and said first and second groups of speakers of said second channel and being operative in response to the frequency of the audio signals in said second channel to provide the output voltage across said second variable voltage divider means to said first group of speakers of said second channel in said first frequency range and to provide the input voltage to both said first and second groups of speakers of said second channel in said second frequency range.

8. The power fader system of claim 7 wherein said first frequency range comprises intermediate and high audio frequencies and said second frequency range comprises low audio frequencies.

9. The power fader system of claim 7 wherein said first and second switch means comprise a capacitive switch operative to provide an open circuit at low frequencies and a closed circuit at intermediate and high frequencies.

10. The power fader system of claim 9 wherein said first and second variable voltage dividers are variable resistors with moveable slider contacts.

* * * * *